US007422187B2

(12) United States Patent
Traut

(10) Patent No.: US 7,422,187 B2
(45) Date of Patent: Sep. 9, 2008

(54) SUPPORT STAND

(75) Inventor: Jennifer M. Traut, 565 N. Washington St., Hinsdale, IL (US) 60521

(73) Assignee: Jennifer M. Traut, La Grange, IL (US)

( * ) Notice: Subject to any disclaimer, the term of this patent is extended or adjusted under 35 U.S.C. 154(b) by 120 days.

(21) Appl. No.: 11/078,796

(22) Filed: Mar. 11, 2005

(65) Prior Publication Data

US 2006/0202094 A1 Sep. 14, 2006

(51) Int. Cl.
*A47B 3/06* (2006.01)

(52) U.S. Cl. ..... 248/431; 248/175; 108/158.11; 108/156

(58) Field of Classification Search ..... 248/164, 248/431, 165, 440.1, 175; 108/91, 158.11, 108/156, 153.1; 297/440.1; 446/489, 487
See application file for complete search history.

(56) References Cited

U.S. PATENT DOCUMENTS 619,362 A * 2/1899 Stevenson ..... 248/175
1,359,388 A * 11/1920 Koerner ..... 47/47
2,730,388 A * 1/1956 Roberton ..... 403/207
2,876,828 A * 3/1959 Mayer ..... 297/440.15
3,659,816 A * 5/1972 Wilson ..... 248/97
4,318,520 A * 3/1982 Walker ..... 248/97
4,354,543 A * 10/1982 Bogner ..... 220/9.4

* cited by examiner

*Primary Examiner*—A. Joseph Wujciak, III
(74) *Attorney, Agent, or Firm*—Welsh & Katz, Ltd

(57) ABSTRACT

Interlocking parts that can be assembled to form a stand are shown. Each part includes at least one leg, and when the stand is assembled, it includes a total of at least three legs, which support the stand. Each part also includes an interlocking buckle member coupled to the legs. The parts are then assembled so that the interlocking buckle members cooperate with each other to form a platform that is supported by the legs. The stand comprises of the legs and the platform. After the stand is no longer needed, the parts can be disassembled and stored; and, when needed again, the interlocking parts may be retrieved from storage and reassembled to form the stand.

13 Claims, 3 Drawing Sheets

SUPPORT STAND

GOVERNMENT SUPPORT

This invention was made with Government support under Contract N00014-02-1-0007 awarded by the Department of the Navy ONR. The Government has certain rights in this invention.

BACKGROUND OF THE INVENTION

The present invention relates to stands that may be used to support people and other objects. In particular, the invention pertains to a multi-piece stand that can be easily assembled, disassembled, and stored.

Chairs, stools, stands and other objects on which individuals may sit or stand, or on which objects may be placed are known. After use of the object is completed, it is often necessary to disassemble the chair, stool or stand, store it somewhere and, when needed, reassemble it.

To address this need, chair manufacturers utilized parts that interlock with each other and that can be disassembled and assembled. These chairs, however, comprise numerous parts that are difficult to manufacture and fit with other parts in order to assemble the chairs. Other manufactures employed a three piece stool made from pliable wood. A portion of each piece that forms the base of the stool must either bend up or down to cooperate with other portions of each piece in order to form the base of the stool, e.g., that portion of the stool on which a person may sit. The problem with such stools is that they are often difficult to disassemble and then reassemble.

Accordingly, there exists a need for an improved multi-part stand that is easy to assemble and disassemble.

BRIEF SUMMARY OF THE INVENTION

The present invention pertains to interlocking parts that can be assembled to form a stand. After the stand is no longer needed, the parts can be disassembled and stored; and, when needed again, the interlocking parts may be retrieved from storage and reassembled to form the stand.

In a first embodiment, a receiving part includes two legs that are coupled to a receiving interlocking buckle member. An inserting part includes two legs that are coupled to an inserting interlocking buckle member. In the first embodiment, the inserting and receiving interlocking buckle members each include inserting and receiving necks and inserting and receiving heads, respectively. The inserting head is inserted and pulled through the receiving head so that portions of the inserting interlocking buckle member rest on portions of the receiving interlocking buckle member. The inserting and receiving interlocking buckle members cooperate to form a platform having voids formed therein. The platform is supported by the legs.

Individuals may then sit on the platform, or place an aesthetically pleasing surface, such as a wooden or glass surface, on the stand. Objects may be placed on the surface, and the stand may be used as a table. When the stand is no longer needed, it may be disassembled by removing the inserting interlocking buckle member from the receiving interlocking buckle member.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
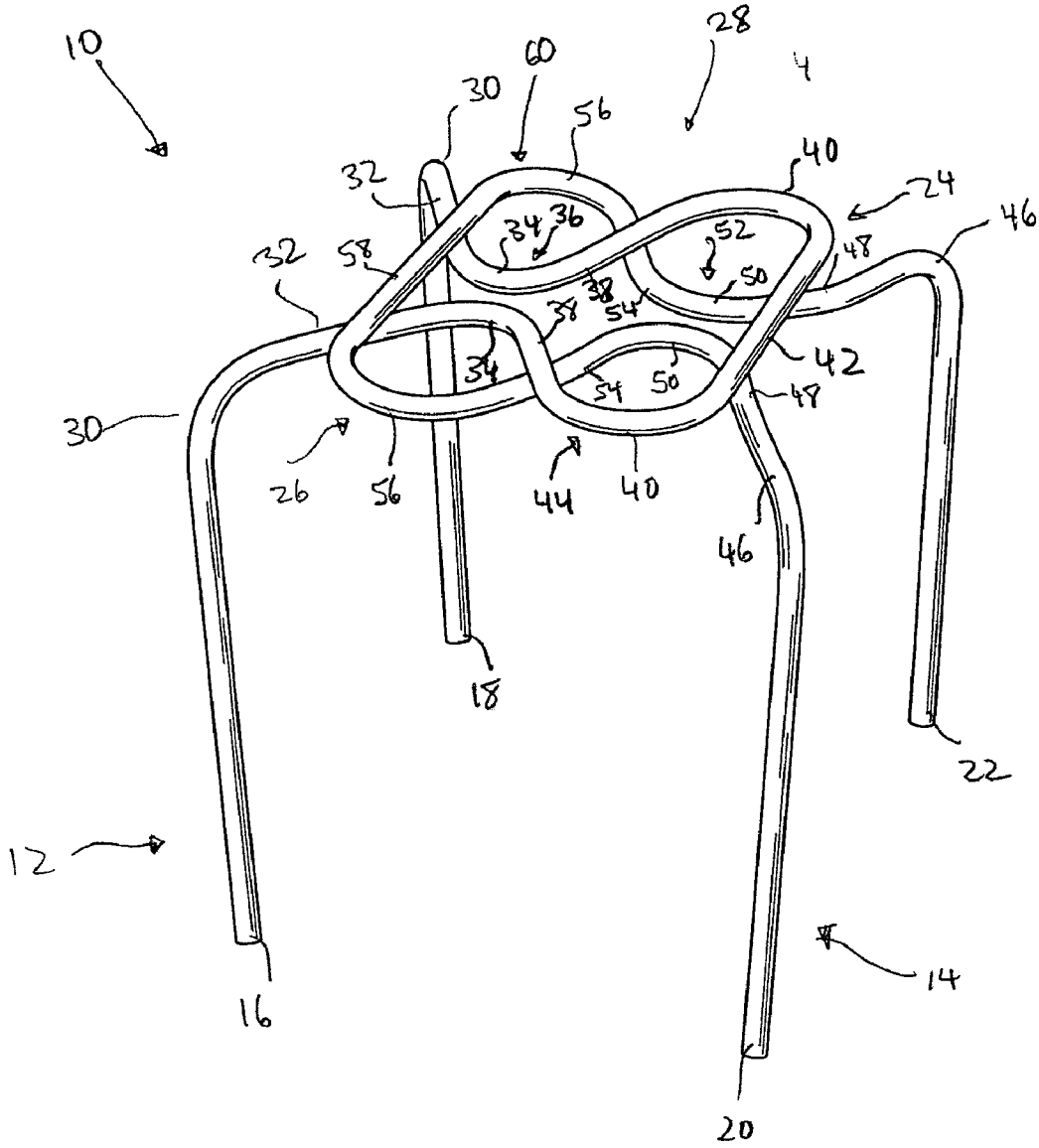
FIG. 1 is a perspective view of the first embodiment of the invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

The present invention pertains to interlocking parts that can be assembled to form a stand. Each part includes at least one leg, and when the stand is assembled, it includes a total of at least three legs, which support the stand. After the stand is no longer needed, the parts can be disassembled and stored; and, when needed again, the interlocking parts may be retrieved from storage and reassembled to form the stand.

FIG. 1 shows a first embodiment of the stand 10 having inserting and receiving parts 12, 14 that cooperate with each other. Each of the inserting 12 and the receiving 14 parts include two legs 16, 18, 20, 22 and an interlocking buckle member 24, 26. The interlocking buckle members 24, 26 cooperate with each other to form a platform 28 that has several voids formed therein, and the legs 16, 18, 20, 22 support the platform. Thus, the stand 10 can support a load in the form of, for example, an individual sitting or standing on the stand, or a surface, such as an aesthetically pleasant wooden board or a glass plane, positioned atop the platform. Objects may be placed atop of the surface.

Note that, although the first embodiment shows inserting and receiving parts 12, 14 having two legs, in other embodiments, either the inserting or receiving part may have one leg and the other part may include two legs—so long as, when assembled, the platform is supported by a total of at least three legs. In such embodiments, the part with one leg and the other with two legs each include an interlocking buckle member extending from the leg(s).

In the first embodiment shown in FIG. 1, the legs 16, 18, 20, 22 are integral with the interlocking buckle member 24, 26. But, in other embodiments, the legs may be coupled to the interlocking buckle member by an intermediate part or area, or be directly welded or fastened to the interlocking buckle member by, for example, fasteners.

Figure 2:
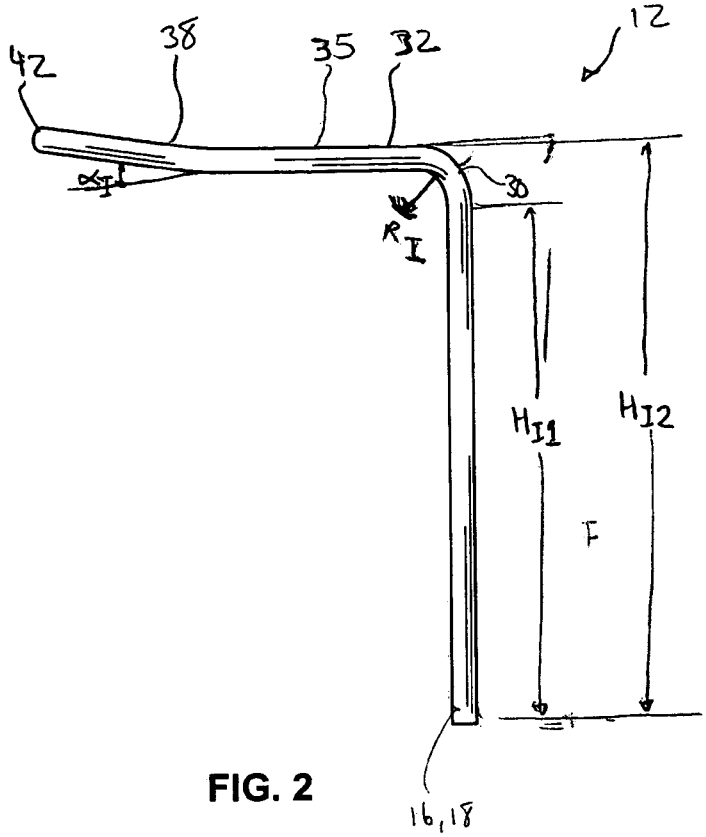
FIG. 2 is a side view of an inserting part of the first embodiment of the invention.
Figure 4A:
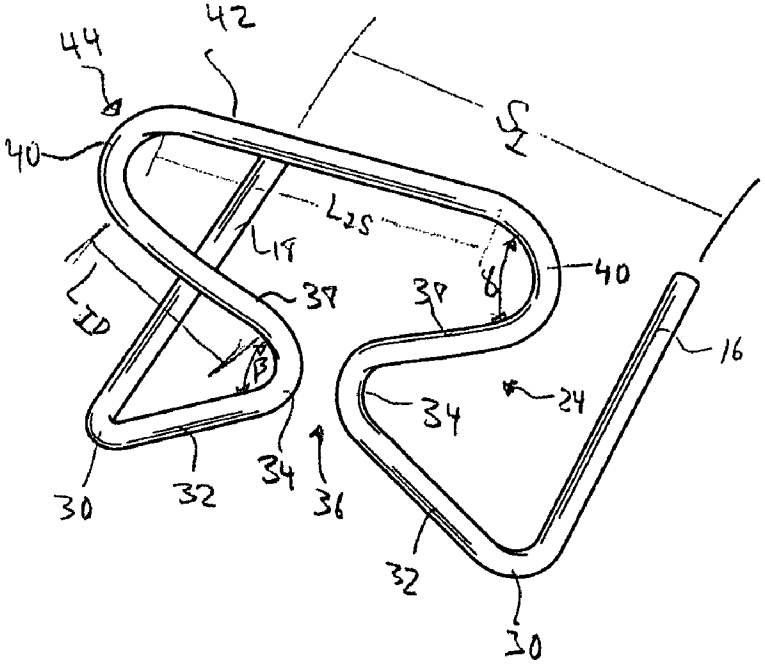
FIG. 4*a* is a perspective view of an inserting part of the first embodiment; and, FIG. 4*b* is a perspective view of a receiving part of the first embodiment invention.

FIGS. 1, 2, and 4*a* shows numerous views of the inserting part 12 of the first embodiment. The legs of the inserting part 16, 18 are spaced $S_l$ about 438 mm from each other and extend up to a height $H_{I1}$, which is about 415 mm in a preferred embodiment. The legs then bend upward and laterally, and in the preferred embodiment, they bend laterally and upward at an arc 30 of about 90° and at a radius $R_I$ of about 57 mm to reach a height $H_{I2}$ of about 482 mm. After bending, the inserting legs 16, 18 extend into supporting segments 32 which converge in the preferred embodiment shown in FIG. 1. The converging segments 32 extend into two curves 34 that form the neck 36. The neck 36 then extends into two diverging segments 38, which in a preferred embodiment, bend upward and are about 109 mm long $L_{ID}$. In a most preferred embodiment, they bend upward at an angle $\alpha_I$ of about 10°. The diverging segments 38 then form two inward bows 40 that form a straight edge 42, which is about 240 mm long $L_{IS}$ in a preferred embodiment. The diverging segments 38, two inward bows 40 and the straight edge 42 form the head 44 of the inserting part 12.

Note that in embodiments incorporating an inserting part having only one leg, instead of legs that extend into converging sections, the one leg extends into a supporting segment that, as explained below, will support portions of the receiving interlocking buckle member. In one embodiment, the supporting segment is straight and separates into two diverging segments to form the head.

Figure 3:
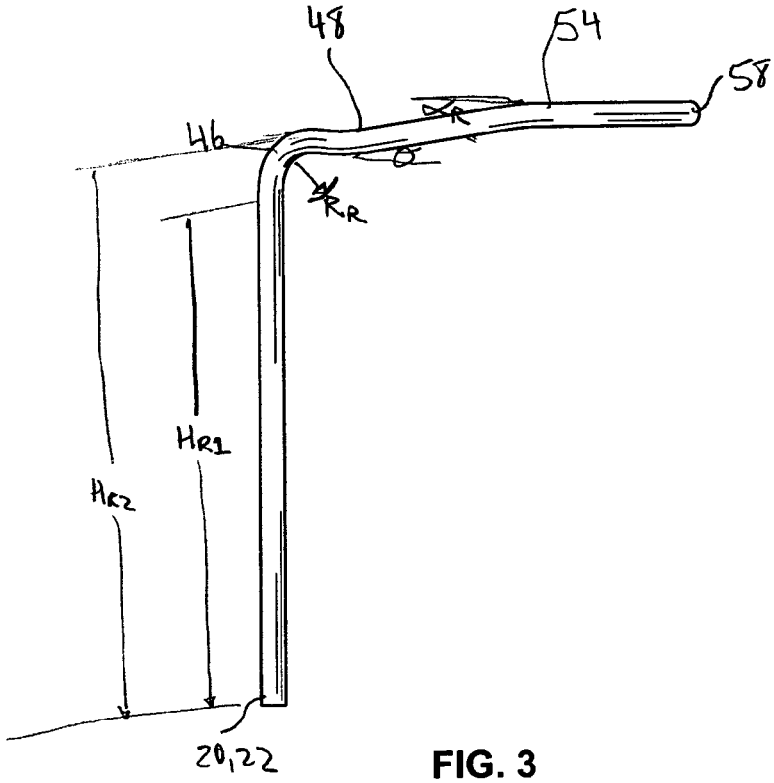
FIG. 3 is a side view of a receiving part of the first embodiment of the invention.

FIG. 3 shows a side view of the receiving part 14 of the first embodiment. The legs 20, 22 of the receiving part are spaced $S_R$ about 438 mm from each other and extend up to a height $H_{R1}$, which is about 415 mm in a preferred embodiment. The legs then bend upward and laterally, and in one embodiment, they bend at an arc 46 of about 93° and at a radius $R_R$ of about 57 mm to reach a height $H_{R2}$ of about 481 mm. After bending, as shown in FIG. 1, the inserting legs 20, 22 extend into supporting segments 48, which converge in the preferred embodiment shown in FIG. 1.

Because the arc 46 is greater than 90°, the converging segments 48 begin to depend downward and then bend back up. In a preferred embodiment, they bend up at an angle θ of about 7°. The converging segments 48 then converge into two curves 50 that form the neck 52. The neck 52 extends into two diverging segments 54, which in a preferred embodiment, are about 109 mm long $L_{RD}$ and also bend upward. In a most preferred embodiment, they bend at an angle $\alpha_R$ of about 10°. The diverging segments 54 then form two inward bows 56 that form a straight edge 58, which is about 240 mm long $L_{RS}$ in a preferred embodiment.

In a most preferred embodiment shown in FIG. 1, the curves 34, 50 of the necks 36, 52 of both the inserting and receiving parts 12, 14 bend at an angle β of about 120°, and the bows 40, 56 of the inserting and receiving parts 12, 14 bend at an angle γ of about 150°. The interlocking buckle member 24, 26 of each part 12, 14 includes the neck 36, 52, which is formed by the converging segments 32, 48 and the two curves 34, 50, and the head 44, 60, which is formed by the diverging segments 54, bows 40, 56 and straight edge 42, 58.

As shown in FIG. 1, the interlocking buckle members 24, 26 of the inserting and receiving parts 12, 14 cooperate with one another to form the platform 28 having voids in it. Specifically, the head 44 of the inserting part 12 is inserted and pulled through the head 60 of the receiving part 14. The straight segment 42, 58 of the head 44, 60 of the inserting 12 and receiving 14 parts then rest atop the converging segments 32, 48 of the receiving and inserting parts, respectively. The diverging segments 38 of the inserting part 12 rest atop the diverging segments 54 of the receiving part 14.

Preferably, the parts 12, 14 are dimensioned so that the platform 28 is substantially flat, allowing individuals to sit on the platform or accommodating surfaces to be placed thereon. The platform is supported by the legs of the stand, and as explained above, the stand should have at least three legs and has four in the preferred embodiment shown in the figures.

In the preferred embodiment, the parts 12, 14 are comprised of galvanized steel tubing that has a diameter of about 19 mm. Those of skill in the art will appreciate that several types of materials and diameters can be used to achieve a desired weight bearing capacity. Several dimensions, such as the height of the legs, diameter and/or material of the tubing, and distance between the legs, may all be varied to provide the desired load bearing capacity for the stand. For example, in another embodiment, 19 mm diameter galvanized steel tubing provided adequate support for a four legged support stand having dimensions that were uniformly twenty percent greater than the dimensions of the preferred embodiment depicted in the Figures.

Although the preferred embodiment shows a specific head/neck shape 44, 36, 60, 52 for the interlocking buckle members 24, 26, those of skill in the art will appreciate that there are a variety of shapes that maybe used for the interlocking buckle members. For example, there are a variety of different variations of the head/neck shapes. The head may be shaped like a rectangle, pentagon, triangle, octagon or a variety of other shapes. Further, the interlocking buckle members may be formed from shapes other than the head/neck shapes, such as from rectangles, pentagons, triangles, octagons and the like. In yet other embodiments, the shape of the interlocking buckle member of the receiving part may differ from the shape of the inserting part.

Figure 4B:
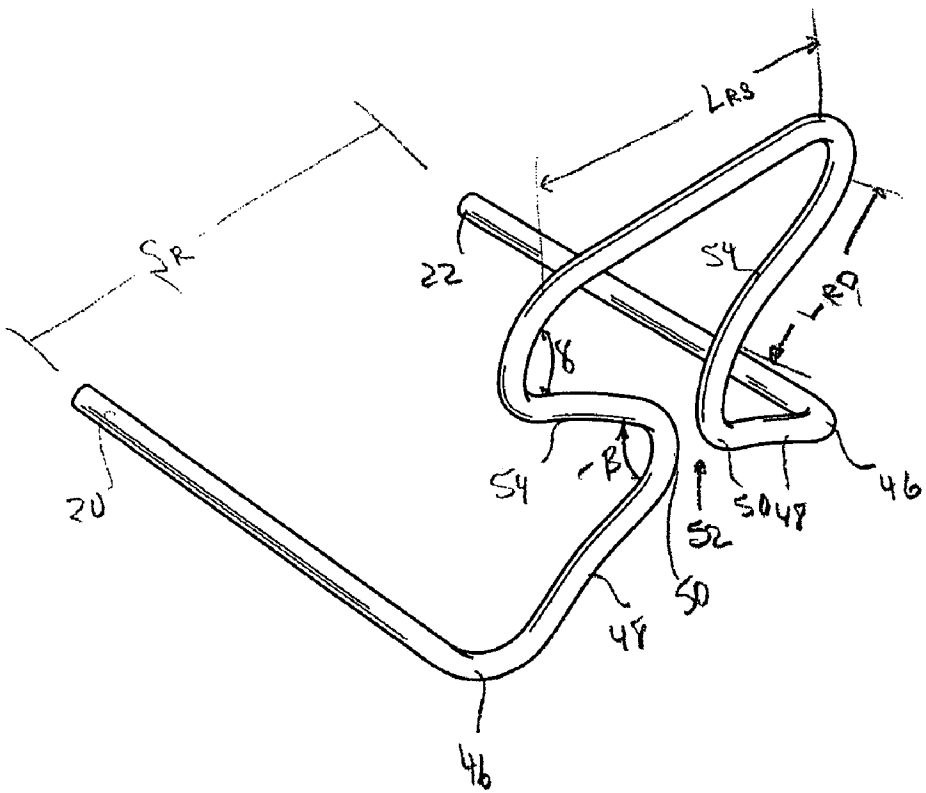

After the stand 10 is used, the inserting and receiving parts 12, 14 may be disassembled, as shown in FIGS. 4(*a*) and (*b*). The disassembled inserting and receiving parts 12, 14 may then be easily stored. When the stand 10 is needed again, the parts 12, 14 may be reassembled, as explained above, by inserting the head 44 of the inserting part 12 into the head 60 of the receiving part 14.

From the foregoing it will be observed that numerous modifications and variations can be made to the invention without departing from the true spirit and scope of the novel concepts of the present invention. It is to be understood that no limitation with respect to the specific embodiments illustrated is intended or to be inferred. The disclosure is intended to cover all such modifications as fall within the scope of the invention.

What is claimed is:

1. A stand, comprising:

an inserting part including first and fourth legs spaced from one another, converging segments, a neck, and a head; the converging segments, neck and head of the inserting part forming an inserting interlocking buckle member, the first and the fourth legs coupled to the inserting interlocking buckle member;

a receiving part including second and third legs spaced from one another, converging segments, a neck, and a head; the converging segments, neck and head of the receiving part forming a receiving interlocking buckle member; the second and third legs coupled to the receiving interlocking buckle member wherein the converging segments extend from the second and third legs to the neck of the receiving part, the converging segments configured such that they become closer together as they extend towards the neck of the receiving part and the first and fourth legs to the neck of the inserting part, the converging segments configured such that they become closer together as they extend toward the necks of the receiving part and inserting part;

the head of the inserting and receiving parts having diverging segments extending from the neck and a straight edge opposite the neck;

wherein the inserting interlocking buckle member is inserted through the receiving interlocking buckle member so that the inserting and receiving interlocking buckle members cooperate with one another to form a platform having a plurality of voids therein, the platform being supported by the first, second and third legs wherein the diverging segments of the inserting interlocking buckle member rest directly atop and adjacent the diverging segments of the receiving interlocking buckle member, the straight edge of the head of the inserting part rests directly atop the converging segments of the receiving part, and the straight edge of the head of the receiving part rests directly atop the converging segments of the inserting part.

2. The stand of claim 1, wherein the inserting interlocking buckle member is defined by a first shape, and the receiving interlocking buckle member is defined by a second shape different from the first shape of the inserting interlocking buckle member.

3. The stand of claim 1, wherein supporting segments of the inserting part integrally extend from the first leg and the supporting segments of the receiving part integrally extend from the second and third legs.

4. The stand of claim 3, wherein the inserting part further comprises a fourth leg spaced from the first leg and coupled to the inserting interlocking buckle member, and wherein the inserting part further comprises the supporting segments, each extending from the first and fourth legs.

5. The stand of claim 1, wherein the supporting segments of both the receiving and inserting parts further comprise converging segments that converge laterally inward to form two curves, the necks of both the receiving and inserting parts further comprising the converging segments and the curves of both the receiving and inserting parts.

6. The stand of claim 1, wherein the diverging segments of the head of the inserting and receiving parts extend from the neck into curved bows, the bows bending inwardly into the straight edge.

7. The stand of claim 1, wherein portions of the inserting interlocking buckle member bend once.

8. The stand of claim 1, wherein portions of the receiving interlocking buckle member bend twice.

9. The stand of claim 1, wherein the inserting interlocking buckle member is indirectly coupled to the first leg, and the receiving interlocking buckle member is indirectly coupled to the second and third legs.

10. The stand of claim 1, wherein the inserting interlocking buckle member is welded to the first leg, and the receiving interlocking buckle member is welded to the second and third legs.

11. A support stand comprising:

an inserting part having first and second legs, converging segments, a neck, and a head; the converging segments, neck and head of the inserting part forming an inserting interlocking buckle member; the first and second legs contiguously extending into the inserting interlocking buckle member;

a receiving part having third and fourth legs, converging segments, a neck and a head; the converging segments, neck and head of the receiving part forming a receiving interlocking buckle member, the third and fourth legs contiguously extending into the receiving interlocking buckle member wherein the converging segments extend from the second and third legs to the neck of the receiving part, the converging segments configured such that they become closer together as they extend towards the neck of the receiving part and the first and fourth legs to the neck of the inserting part, the converging segments configured such that they become closer together as they extend toward the necks of the receiving part and inserting part;

the head of the inserting and receiving parts having diverging segments extending from the neck and a straight edge opposite the neck;

wherein the inserting head is inserted through the receiving head so that the diverging segments of the inserting interlocking buckle member rest directly atop and adjacent the diverging segments of the receiving interlocking buckle member, the straight edge of the inserting head rests directly atop converging segments of the receiving part and the straight edge of the receiving head rests directly atop converging segments of the inserting part so that the inserting and receiving interlocking buckle members interlock with each other to form a platform that is supported by the first, second, third and fourth legs.

12. The support stand of claim 11, wherein the inserting and receiving heads each comprise diverging segments, bows and a straight edge.

13. The support stand of claim 12, wherein the inserting and receiving necks each comprise converging segments and curves.

* * * * *